United States Patent [19]

Peche

[11] 4,243,859

[45] Jan. 6, 1981

[54] VACUUM SWITCH

[75] Inventor: Gerhard Peche, Berlin, Fed. Rep. of Germany

[73] Assignee: Siemens Aktiengesellschaft, Berlin & Munich, Fed. Rep. of Germany

[21] Appl. No.: 941,310

[22] Filed: Sep. 11, 1978

[30] Foreign Application Priority Data

Sep. 12, 1977 [DE] Fed. Rep. of Germany ..... 2740994

[51] Int. Cl.[3] ..... H01H 33/66

[52] U.S. Cl. ..... 200/144 B; 200/266; 200/279

[58] Field of Search ..... 200/144 B, 266, 279, 200/237, 238, 239

[56] References Cited

U.S. PATENT DOCUMENTS

| | | | |
|---|---|---|---|
| 3,065,321 | 11/1962 | Ainsworth | 200/144 B |
| 3,818,164 | 6/1974 | Mizutani et al. | 200/144 B |
| 3,941,961 | 3/1976 | Kopplin | 200/144 B |
| 3,980,850 | 9/1976 | Kimblin | 200/144 B |

FOREIGN PATENT DOCUMENTS

| | | |
|---|---|---|
| 1210933 | 2/1966 | Fed. Rep. of Germany . |
| 1196751 | 3/1966 | Fed. Rep. of Germany . |

*Primary Examiner*—James R. Scott

*Attorney, Agent, or Firm*—Hill, Van Santen, Steadman, Chiara & Simpson

[57] ABSTRACT

An improved vacuum switch has slotted, flexible, discus-shaped contact discs attached to the current carrying contact bolts. In the open circuit case, a gap exists between each contact bolt and its corresponding contact disc and between the two discs. In the closed circuit case, the contact bolts drive the contact discs against one another, slightly deforming the contact discs, resulting in a low resistance current path. As the switch starts to open, the contact bolts first separate from the adjacent disc surfaces. As the switch opens further, any arc that ignites exists only between the contact discs. Tangential slots in the contact discs guide the arc toward the center of the contact discs. The flexible discs assume their previous undistorted shape when the switch has opened.

17 Claims, 6 Drawing Figures

VACUUM SWITCH

BACKGROUND OF THE INVENTION

1. Field of the Invention

This invention pertains to the field of high power vacuum switches.

2. The Prior Art

A multiplicity of different contact geometry designs for vacuum switches is known. However, in the art so far only disc or pot-shaped contact designs have made any inroads (compare for example German Display Copies Nos. 1,210,933 and 1,196,751). Generally, the disc-shaped contact designs are more favorable cost-wise than the pot-shaped designs, because their machining is considerably simpler. Disc-shaped contacts have a central current feed and in the beveled edge of the disc some crescent-shaped slots are provided.

A considerable improvement of this proven contact geometry is described in the German Publication Copy No. 2,352,540. In these vacuum switch contacts both the central contact surfaces and the arc baffles have a separate current feed. The result is that in case of a migration of the arc contact points in a radial direction initially, the current forces removed from the center increase. However, forces acting in central direction occur when the contact points approach the edge of the switch parts. Thus no current forces can occur which expel the arcs from the area between the switch contacts. However, it is a disadvantage that switch contacts with this contact geometry can be produced with difficulty and the contacts become very costly. Moreover, the arc has a good opportunity to contract on the central current feed because of the low resistance of the contact bolts. Thus, contact erosions may be created which are undesirable on switch contact surfaces of vacuum switches. Moreover, gaps with sharp edges are undesirable at the most narrow point of the contact gap because of the high electric field strength developing at the edges at dielectric stress.

SUMMARY OF THE INVENTION

The invention is a less expensive vacuum switch comprising a stationary and a mobile contact bolt. The adjacent contact surfaces of the two contact bolts are covered by contact disks. Each disk is hollow and has a more or less eliptical cross-section. The interior hollow regions are annular in shape. The discs are flexible and spring back to their original shape once a distorting force has been removed.

Each disk is mounted on the contact end of a bolt so that in the open state, a gap exists between the end of that contact bolt and the adjacent bottom interior surface of the disk. When the switch is fully closed however, the two contact bolts are driven together and sandwiched between the contact ends of the contact bolts and the bottom surfaces of the contact disks. In the closed condition the gaps are eliminated.

The disks are slightly flexed when the switch is closed. As a result, as the switch starts to open, the ends of the contact bolts first separate from the adjacent bottom interior surfaces of their respective contact disks thereby restoring the gaps. As a result since the contact bolt ends separate from their associated contact disks before the contact disks start to separate from each other, any arc that may start occurs only between the external adjacent surfaces of the contact disks. No arcs exist between the ends of the contact bolts.

The contact disks each are pierced or have an aperture at least at one point on a surface away from the contact surfaces so that the same pressure which exists throughout the rest of the switch exists in the interior of the contact disks.

In order to produce a rotation of the arc, the surfaces of each contact disk contain a number of oblique slots. These slots are straight and start at the periphery of each contact disk and extend tangentially toward the associated contact bolt. The slots on each pair of contact discs in a given switch are aligned opposite one another.

An alternate embodiment of the invention has contact disks with a cylindrical cross section. A tubular section joints the top and bottom sections of the basic contact disk. This enlargement of the contact disks allows the switch to have a higher current rating without the necessity of having a larger diameter. This form of the contact disk may also be slotted with tangential, straight cuts.

The contact bolts may be essentially pure copper or may be an alloy of copper and boron, chromium, zirconium or beryllium or a mixture thereof. The contact ends of the contact bolts may be coated with a chromium-copper, tungsten-copper, cobalt-copper or molybdenum-copper alloy.

The contact disks have adjacent contact surfaces which may be fabricated of a cobalt-copper, chromium-copper, tungsten-copper or molybdenum-copper alloy. The non-adjacent surfaces of the contact disks may be fabricated of copper or copper alloyed with boron, chromium, zirconium or beryllium or a mixture thereof. The intermediate tubular member in the alternate embodiment of the invention may be fabricated of a boron-copper, chromium-copper, zirconium-copper or beryllium-copper alloy.

DETAILED DESCRIPTION OF THE PREFERRED EMBODIMENTS

Figure 1:
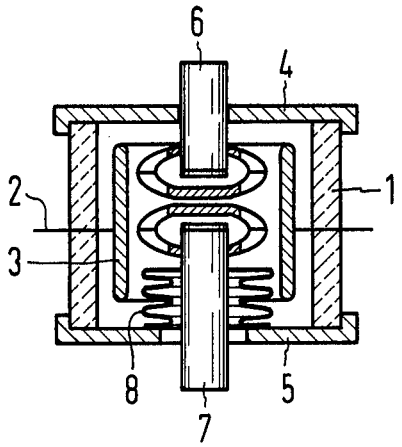
FIG. 1 is a pictorial diagram, partially in section of a vacuum switch.

While the contact discs of the present invention have been disclosed for use in a vacuum switch, it will be understood that they may be utilized in other combinations. By way of practicing the best mode of the invention and not of limitation there is shown in FIG. 1 a vacuum switch incorporating the contact discs of the present invention. The vacuum switch represented in FIG. 1 comprises a tubular insulating body 1, in the center of which a metallic screen or shield 3 is suspended via a flange 2. The tubular insulating body 1 is sealed by a pair of metallic terminal flanges 4 and 5. The screen 3 concentrically surrounds a pair of switch contacts 6, 7. Switch contact 6 is a stationary contact and is affixed to the flange 4. The mobile switch contact 7 is guided through the terminal flange 5 and sealed vacuum-tight via a metallic bellows 8 fastened internally at the terminal flange 5. The pumping lead, via which the vacuum switch is evacuated is not shown in the figure. The inventive contact design is identical for the stationary contact 6 and the movable switch contact 7, except for a set of slots to be discussed subsequently.

Figure 2:
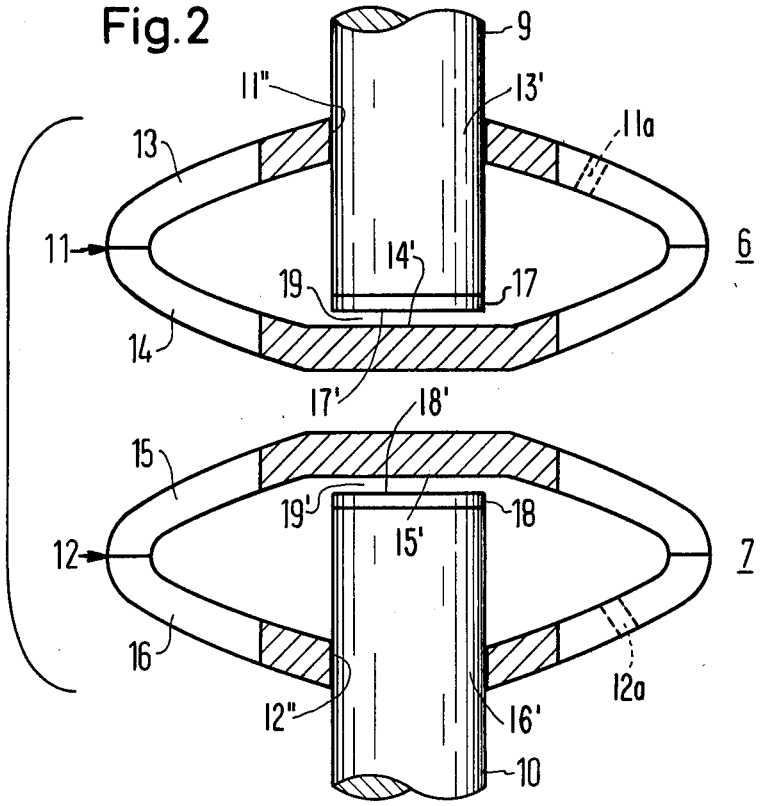
FIG. 2 is an enlarged partial section of the contact discs of the present invention.

As disclosed by FIG. 2, the switch contacts 6, 7 have a pair of corresponding contact bolts 9, 10. The contact bolts 9, 10 each have affixed thereto a contact disk 11, 12. The disk 11 has a top surface 13 and a bottom surface 14. The disk 11 with a centered hole 11'' has a more or less eliptical cross-section and is attached to the contact bolt 9 at a region 13'. The interior of the disk 11 is hollow with an annular shape. The contact disk 12 has a bottom surface 15 and a top surface 16. The shape of the disks 11 and 12 is identical. The disk 12 with a centered hole 12'' is affixed to the contact bolt 10 at a region 16'. Each disk 11, 12 has an aperture **11*a*, 12*a* through the respective top surface 13, 16** to equalize pressure within the disks with respect to the pressure outside of the disks.

The contact bolts 9 and 10 have contact ends 17, 18 with frontal surfaces 17',18'. Each end 17, 18 is separated from an interior surface 14', 15' of the surface 14, 15 of the contact disk 11, 12 by a gap 19, 19'. The contact ends 17, 18 preferably have an appropriate contact coating thereon. Possible coatings include alloys of chromium-copper, tungsten-copper, cobalt-copper or molybdenum-copper.

The solid contact bolts 9, 10 preferably are made of copper and their performance can be substantially improved by a 1% (by weight) addition of boron, beryllium, chromium and/or zirconium. The frontal surfaces 17',18' of the contact bolts 9, 10 are effectively enlarged by the discus-shaped contact disks 11, 12. The sides 14, 15 facing each other are produced from an appropriate arc resistant contact material preferably an alloy of chromium-copper, tungsten-copper, cobalt-copper or molybdenum-copper. Sides 13, 16 of the contact disks 11, 12, facing away from each other, consist preferably of pure copper or of copper alloyed with 1 to 3% (by weight) boron, beryllium, chromium and/or zirconium.

The surfaces 13, 14 of the contact disc 11 are hard soldered together at a seam 11'. Similarly, the surfaces 15, 16 of the disc 12 are also hard soldered together at a seam 12'. The connections between the discs 11, 12 and the contact bolts 9, 10 at the regions 13' and 16' are also made by hard solder.

Figure 3:
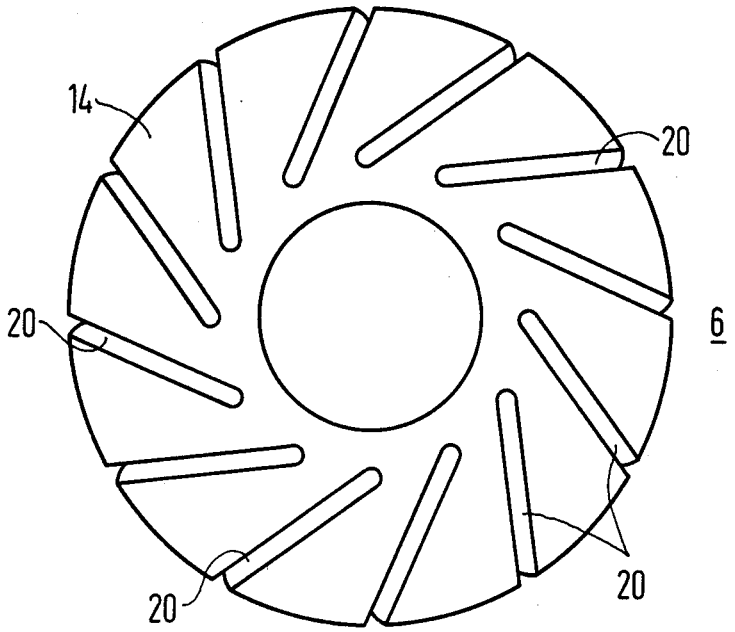
FIG. 3 is an enlarged top view of a contact disc of the present invention.
Figure 4:
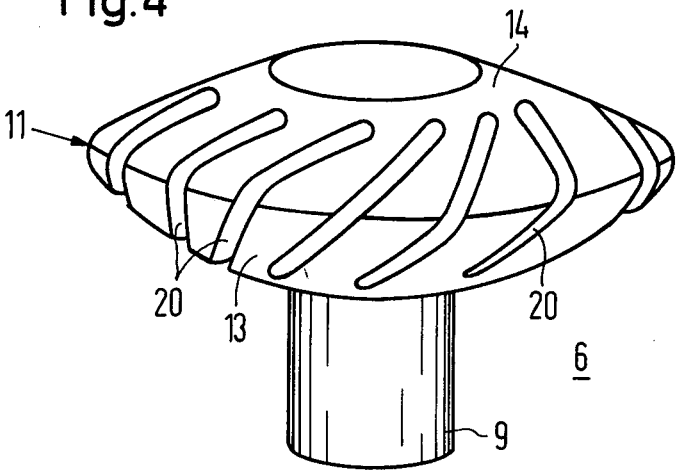
FIG. 4 is an enlarged perspective view of a contact disc of the present invention.

To electro-magnetically move the contact points of the burning discharge, oblique slots 20 are provided at the outer circumference of the discus-shaped contact discs 11, 12 as can be seen from FIGS. 3 and 4. The slots 20 preferably are straight in themselves and may be cut with a circular saw. It is advantageous to use boron-alloyed copper for the contact discs 11, 12 as then the cut edges remain free from burrs. The slots 20 are in the disk 11 associated with the non-moving contact 6. The corresponding slots 20' in the disk 12 of the moving contact 7 are cut in the reverse direction. (See FIG. 6)

Vacuum switches with high rated short circuit disconnect currents and correspondingly rated short circuit connecting currents (2.5 times) require relatively high contact pressures so that the electrodynamic forces of the connecting or starting current will not open the contacts. The contacts disks 11, 12 are slightly elastic or flexible. When the switch is closed, contact bolts 9, 10 are driven against the respective surfaces 14' and 15' and the surfaces 14 and 15 are driven adjacent to one another. Thus the gaps 19, 19' are eliminated and a low resistance closed current path is completed between the contacts 6 and 7. Because the disks 11, 12 are flexible, the slight distortion which results on closure does not damage them. The disks 11, 12 have a built in spring bias that returns them to their original shape.

At the moment of disconnection, first the inner gaps 19, 19' between the frontal surfaces 17',18' of the contact bolts 9, 10 and the inner walls 14', 15' of the sides 14, 15 of the contact disks 11, 12 open. As a result, the arc ignited between the two sides 14, 15 facing each other is fed only via the contact disks 11, 12. Thus, the arc contact or foot points are guided through the oblique slots so on a circular path toward the center of the discharge. Because of their spring-like characteristic, the disks 11, 12 return to their original shape when the bolts 9, 10 separate.

The frontal surfaces 17',18' of the contact bolts 9, 10, preferably are of chromium-copper, tungsten-copper, cobalt-copper or molybdenum copper, to avoid coalescence of contacts between the frontal surfaces 17',18' of the contact bolts 9, 10 and the inner sides 14', 15' of the surfaces 14, 15 of the contact disks 11, 12. The contact bolts 9, 10 may be provided at the soldering regions 13' and 16' with a ledge not shown which automatically provides for the corresponding interior gaps 19, 19'.

Figure 5:
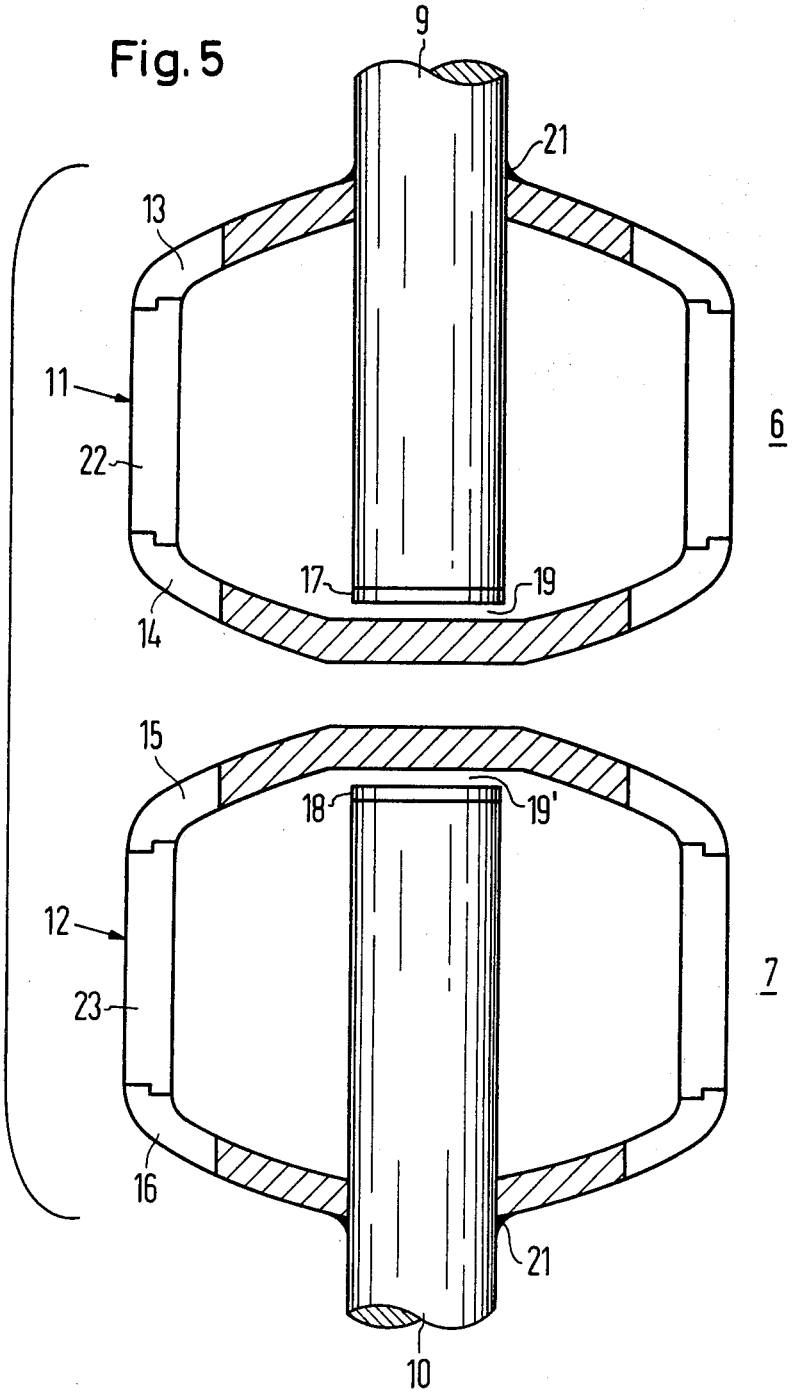
FIG. 5 is an enlarged partial section view of an alternate embodiment of the contact disk of the present invention.

In an alternate switch embodiment shown in FIG. 5, a pair of tubular intermediate parts 22, 23 are inserted between the sides 13, 16 facing away from each other and the sides 14, 15 facing each other of both contact disks 11, 12. In this embodiment, a rolled-on stop 21 is provided at the soldering point on the contact bolts 9, 10 which provides for the corresponding interior gaps 19, 19'.

The advantage of this embodiment is that higher currents may safely be switched without requiring a larger diameter housing 1.

The intermediate tubular members 22, 23 are formed from an alloy of boron-copper, chromium-copper, zirconium-copper or beryllium-copper.

Figure 6:
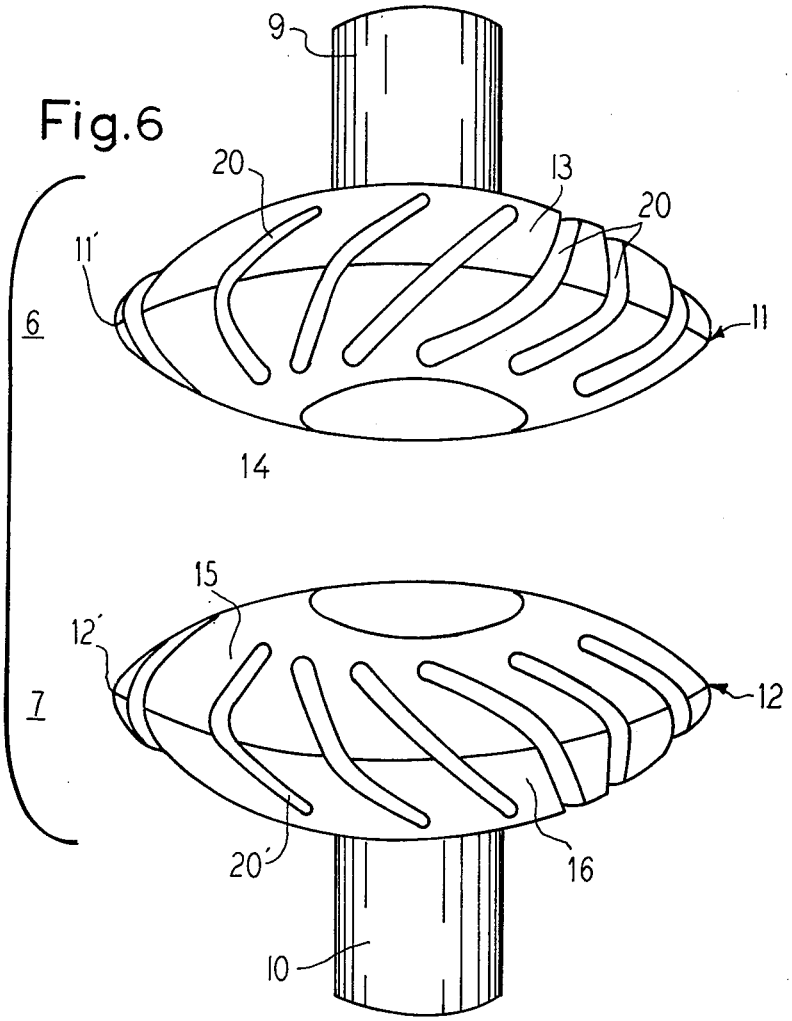
FIG. 6 is an enlarged perspective view of a pair of contact discs with opposing slots.

FIG. 6 shows the two sets of opposing slots 20, 20' associated with the two contacts 6 and 7. If desired, corresponding slots could be used with the alternate embodiment of FIG. 5.

Although various modifications might be suggested by those skilled in the art, it should be understood that I wish to embody within the scope of the patent warranted hereon all such modifications as reasonably and properly come within the scope of my contribution to the art.

I claim as my invention:

1. An improved vacuum switch having a fixed and a movable electrical contact operably mounted in a vacuum housing:

the improvement comprising a pair of deformable contact disks, one mounted at the contact end of each electrical contact;

each of said contact disks having an interconnected top and bottom member with said top member being fixedly attached to the body portion of one of the contacts near the contact end and with each said bottom member being adjacent to but not in contact with a contact surface of the contact end to which said contact disk is fixedly attached and adjacent to but not in contact with said other bottom member when the contacts are separated from one another;

whereby when the contacts are driven toward one another, to close the switch, said bottom members are brought into contact with one another and said disks deform slightly to permit each of the contact surfaces to move into contact with a said adjacent bottom member, and as the electrical contacts start to move apart, due to the switch opening, the contact surfaces separate from each of said bottom members of said contact disks before said bottom members of said contact disks separate from one another due to each of said disks returning to its undeformed shape.

2. The improved vacuum switch according to claim 1 wherein at least one of said contact disks formed by said top and bottom members has a closed hollow discus shape.

3. The improved vacuum switch according to claim 2 wherein a said top member of at least one of said contact disks has an aperture therethrough.

4. The improved vacuum switch according to claim 2 wherein at least one of said contact disks has a plurality of straight slots thereon with each said slot oriented tangential to the body portion of the associated contact.

5. The improved vacuum switch according to claim 2 wherein each of said contact disks has a plurality of spaced apart straight slots thereon with each said slot oriented tangential to the body portion of the associated contact, the members of said plurality of slots associated with said contact disk mounted on the stationary electrical contact have an orientation contrary to the orientation of the plurality of slots associated with said contact disk mounted on the movable electrical contact.

6. The improved vacuum switch according to claim 2 wherein at least one of said contact disks includes a cylindrical member located between and attached to said top and said bottom members to form a closed, hollow cylindrical structure with a top and bottom having substantially a discus-shaped cross-section.

7. The improved vacuum switch according to claim 6 wherein said cylindrical member comprises a material selected from a group consisting essentially of boron-copper, chromium-copper, zirconium-copper, beryllium-copper.

8. The improved vacuum switch according to claim 1 wherein at least one of said contact disks includes a tubular member located between and attached to said top and bottom members.

9. The improved vacuum switch according to claim 8 wherein said tubular member comprises a material selected from a group consisting essentially of boron-copper, chromium-copper, zirconium-copper, beryllium-copper.

10. The improved vacuum switch according to claim 2 wherein the electrical contacts consist essentially of copper.

11. The improved vacuum switch according to claim 10 wherein said copper contacts comprise an alloy of copper and a maximum of 1% of a material selected from a group consisting essentially of boron, chromium, zirconium, beryllium or a combination thereof.

12. The improved vacuum switch according to claim 2 wherein said electrical contacts each have a contact surface which is coated with an alloy selected from a group consisting essentially of chromium-copper, tungsten-copper, cobalt-copper, molybdenum-copper.

13. The improved vacuum switch according to claim 2 wherein said bottom member comprises an alloy selected from a group consisting essentially of chromium-copper, tungsten-copper, molybdenum-copper, cobalt-copper.

14. The improved vacuum switch according to claim 2 wherein said top member consists essentially of copper.

15. The improved vacuum switch according to claim 14 wherein said top member comprises an operative alloy of copper and a material selected from a group consisting essentially of boron, chromium, zirconium, beryllium or a combination thereof.

16. The improved vacuum switch according to claim 15 wherein said alloy comprises an alloy of copper and 1% to 3% of a material selected from a group consisting essentially of boron, chromium, zirconium, beryllium or a combination thereof.

17. In a vacuum switch having a first and a second electrical contact, each having a contact surface, a vacuum housing which operatively supports the electrical contacts and a pair of contact disks affixed to the electrical contacts an improvement wherein each contact disk comprises:

an electrically conductive, flexible disk-shaped hollow member having an interconnected top and bottom surface;

said top surface having a centered hole therethrough and said bottom surface having a substantially centered, flattened contact region;

the electrical contact extends through said centered hole and is attached to said contact disk such that there is a gap between the contact surface of the respective electrical contact and said bottom member of said contact disk, said disk-shaped member has a plurality of straight slots thereon, each member of said plurality of slots is oriented so as to be tangent to the electrical contact attached to said disk;

when the switch is closed, the two electrical contacts are driven toward one another so that said respective bottom members of said contact disks are brought into electrical contact with each other and with the contact ends of the electrical contacts and, when the switch begins to open, the contact ends of the electrical contacts separate from the said respective bottom members of the said contact disks before the said respective bottom members of the said contact disks separate from one another.

* * * * *